US009006623B2

(12) United States Patent
Nagao et al.

(10) Patent No.: US 9,006,623 B2
(45) Date of Patent: Apr. 14, 2015

(54) HIGH-FREQUENCY INDUCTION HARDENING APPARATUS FOR METAL OBJECTS

(75) Inventors: Takehiko Nagao, Osaka (JP); Noboru Tsukamoto, Yamatokoriyama (JP)

(73) Assignee: Fuji Electronics Industry Co. (JP)

( * ) Notice: Subject to any disclaimer, the term of this patent is extended or adjusted under 35 U.S.C. 154(b) by 1549 days.

(21) Appl. No.: 12/220,891

(22) Filed: Jul. 29, 2008

(65) Prior Publication Data

US 2009/0032526 A1 Feb. 5, 2009

(30) Foreign Application Priority Data

Jul. 31, 2007 (JP) ..... 2007-199171

(51) Int. Cl.
*H05B 6/10* (2006.01)
*H05B 6/22* (2006.01)
*H05B 6/36* (2006.01)

(52) U.S. Cl.
CPC ..... *H05B 6/101* (2013.01)

(58) Field of Classification Search
CPC ..... H05B 6/101; H05B 6/36; H05B 6/40; H05B 6/44
USPC ..... 219/602, 652, 676, 639, 640, 635, 600, 219/643, 662; 266/103, 252, 90
See application file for complete search history.

(56) References Cited

U.S. PATENT DOCUMENTS

| | | | | |
|---|---|---|---|---|
| 3,967,089 | A * | 6/1976 | Seulen et al. | 219/652 |
| 4,459,451 | A * | 7/1984 | Regele | 219/639 |
| 6,407,372 | B1 * | 6/2002 | Nakamura | 219/639 |
| 6,514,455 | B1 * | 2/2003 | Watanabe et al. | 266/252 |

FOREIGN PATENT DOCUMENTS

| | | |
|---|---|---|
| JP | 2002-167620 | 6/2002 |
| JP | 2002-348614 | 12/2002 |
| WO | WO 2007003222 A1 * | 1/2007 |

* cited by examiner

*Primary Examiner* — Henry Yuen
*Assistant Examiner* — Hung D Nguyen
(74) *Attorney, Agent, or Firm* — Wood, Phillips, Katz, Clark & Mortimer

(57) ABSTRACT

A high-frequency induction hardening apparatus used for metal objects, including a heating coil holder (4) carrying a heating coil (40) for hardening a metal object (2), an eccentric rotor assemble housing a cam mechanism for allowing the heating coil to eccentrically rotate through the heating coil holder (4); and a pair of supporters (11), (12) for keeping the heating coil holder (4) in a desired position, the supporters (11), (12) limiting the movement of the heating coil holder (4) to a plane intersecting the axis (21) of the cam carried in an eccentric rotor mount (13).

5 Claims, 9 Drawing Sheets

PRIOR ART

HIGH-FREQUENCY INDUCTION HARDENING APPARATUS FOR METAL OBJECTS

TECHNICAL FIELD

The present invention relates to a high-frequency induction hardening apparatus for metal objects such as metal cams, hereinafter referred to as "work", and more particularly, to apparatus for inductively heating and hardening works. Hereinafter, the high-frequency induction hardening apparatus will be referred to as "hardening apparatus" or merely as "the apparatus".

BACKGROUND ART

It is known that a work hardened to different depths will have a reduced strength. It is essential to harden works to an even depth over the entire surfaces. Many proposals have been made; two of the examples are disclosed in Japanese Patents No. 3,499,486 (Reference 1) and No. 3,522,636 (Reference 2).

The References (1) and (2) disclose an apparatus designed to harden a plurality of works, such as cams, mounted on a shaft at different angles, so as to harden their surfaces simultaneously. The apparatus disclosed there have the same structure which shares the feature of hardening works in that the oppositely located two heaters are eccentrically rotated by a single power source. Each heater is provided with a bearing having an eccentric cam, which is connected to the power source by means of a timing belt so as to effect the simultaneous heating.

However, a disadvantage is that the above-mentioned apparatus must require many component parts, which increase the production cost and a relatively large site for installation.

In order to solve the problems, the inventors of the present invention invented a hardening apparatus shown in FIG. 1, having a mount 50 including a heating coil 55. The mount 50 is provided with two bearings 51 and 52 each having their own eccentric cams 53 and 54 driven by shafts 56 and 57, respectively. The shafts 56 and 57 are synchronously rotated. By rotating the two shafts 56 and 57, the heating coil 55 can eccentrically rotate in the same plane as a work 60. While the heating coil 55 is in the eccentric rotation, the work 60 is heated and hardened.

The apparatus shown in FIG. 1 has solved the problems of the known apparatus disclosed in the above-mentioned two literatures (1) and (2), but the difficulty is that the two shafts 56 and 57 are required to rotate in exact synchronism with each other. In order to achieve it, the cams must be made to high precision, thereby increasing the production cost and consuming time. In addition, it is difficult to continue to keep the two shafts 56 and 57 rotating in precise synchronism. Even if a small differentiation occurs between them, the heating coil fails to rotate eccentrically.

Therefore, it is an objective of the present invention to reduce the number of component parts and the area of the installation site, and also to ensure easy maintenance of the hardening apparatus.

SUMMARY OF THE INVENTION

To achieve the above-mentioned objective, a first version embodying the invention includes a heating coil holder for holding a heating coil for hardening a metal object, wherein the coil is held so as to be eccentrically rotative under a cam mechanism; and a supporter for keeping the heating coil in a desired position, the supporter limiting the movement of the heating coil to a plane intersecting the axis of the cam.

According to the first version, the heating coil holder is eccentrically rotated with respect to the work kept by limiting the movement of the heating coil holder to and along the plane by the supporter, thereby making it easy to synchronize the rotation of the cam with that of the work, with the result that the entire surface of the work is heated to an even depth.

A second version embodying the present invention includes a heating coil holder for holding a heating coil for hardening a metal object, wherein the coil is held so as to be eccentrically rotative under a cam mechanism; an eccentric rotor mount for supporting an eccentric rotor so as to enable the rotor to rotate eccentrically under a cam mechanism, wherein the eccentric rotor mount is integrally connected to the heating coil holder, and a supporter for keeping the eccentric rotor mount in a desired position, and urging it to rotate on and along a plane intersecting the axis of the cam mechanism.

According to the second version, the heating coil holder is eccentrically rotated in accordance with the eccentric rotation of the eccentric rotor with respect to the work, thereby ensuring that the entire surface of the work is heated to an even depth.

A third version of the invention includes a heating coil holder for holding a heating coil for hardening a metal object, wherein the coil is held so as to be eccentrically rotative under a cam mechanism; an eccentric rotor mount for supporting an eccentric rotor so as to enable the rotor to rotate eccentrically under a cam mechanism, wherein the eccentric rotor mount is integrally connected to the heating coil holder, and a supporter for supporting the eccentric rotor mount so as to move in two directions other than the axis of the cam mechanism.

According to the third version, as the heating coil holder can move in two directions other than the direction of the axis of the cam shaft, the heating coil heat a work to an even depth while it is in its eccentric rotation.

A fourth version is a modification to the second version or the third version, wherein the heating coil holder comprises a plurality of holders united as a unit, and the eccentric rotor mount comprises a plurality of mounts united as a unit, both units being integrally connected to each other.

According to the fourth version, a plurality of heating coils rotate in accordance with the eccentric rotation of the rotors of the mount, thereby eliminating the necessity of providing a number of eccentric rotors corresponding to that of the heating spots but ensuring that a smaller number of eccentric rotors can heat a greater number of spots on the work.

A fifth version is a modification to any of the first to the fourth versions, wherein the supporter comprises a first supporter and a second supporter, the first supporter moving either the heating coil holder or the eccentric rotor mount in a desired direction, and the second supporter moving the first supporter in different direction.

According to the fifth version, the heating coil holder and/or the eccentric rotor mount are eccentrically rotated in a plane specified by the two supporters.

A sixth version of the embodiment is a modification to the fifth version, wherein the direction in which either the heating coil holder or the eccentric rotor mount is moved by the first supporter intersects with the direction in which the first supporter is moved by the second supporter intersect with each other at right angle.

According to the sixth version, owing to the two moving directions intersecting each other at right angle, the heating coil holder and the eccentric rotor mount can be easily moved in the intersecting directions.

A seventh version is a modification to the fifth version or the sixth version, wherein the direction in which the heating coil holder or the eccentric rotor mount is moved by the first supporter, and the direction in which the first supporter is moved by the second supporter intersects with the axis of the cam mechanism.

According to the seventh version, the heating coil holder and the eccentric rotor mount can move in two directions intersecting each other, thereby causing the heating coils to rotate smoothly with little friction.

An eighth version is a modification to any of the first to seventh versions, wherein the cam mechanism comprises a plurality of cam members mounted on a single shaft.

According to the eighth version, the number of heating coils and eccentric rotors corresponding to that of the cams can be eccentrically rotated.

A ninth version is a modification to the eighth version, wherein each of the cam members is rotatively and integrally connected to the single shaft at a predetermined angular position.

According to the ninth version, the heating coil holder can be directed to the desired heating spot of the work: in other words, each cam is mounted on the same shaft, thereby causing the heating coil or the eccentric rotor to start its eccentric rotation from the predetermined angular position.

DESCRIPTION OF THE PREFERRED EMBODIMENTS

Figure 1:
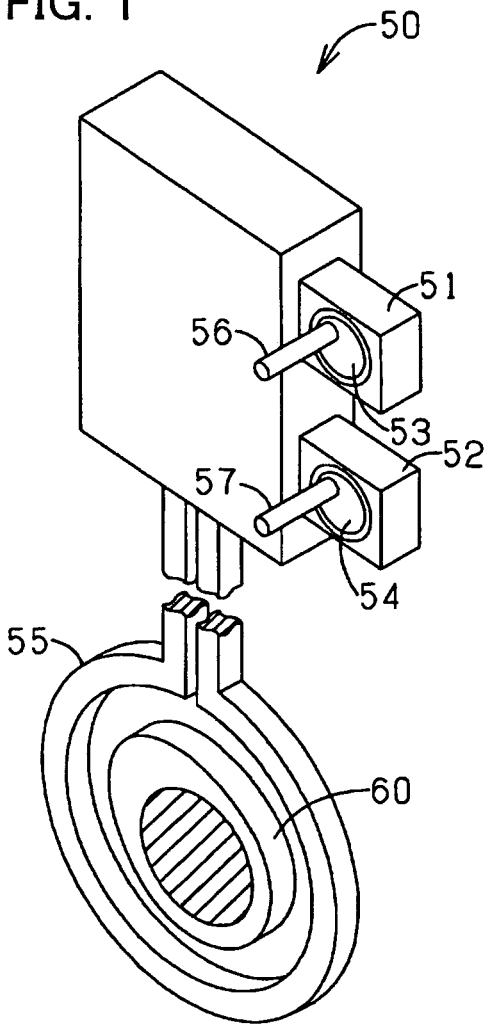
FIG. 1 is a perspective view of a known hardening apparatus.
Figure 2:
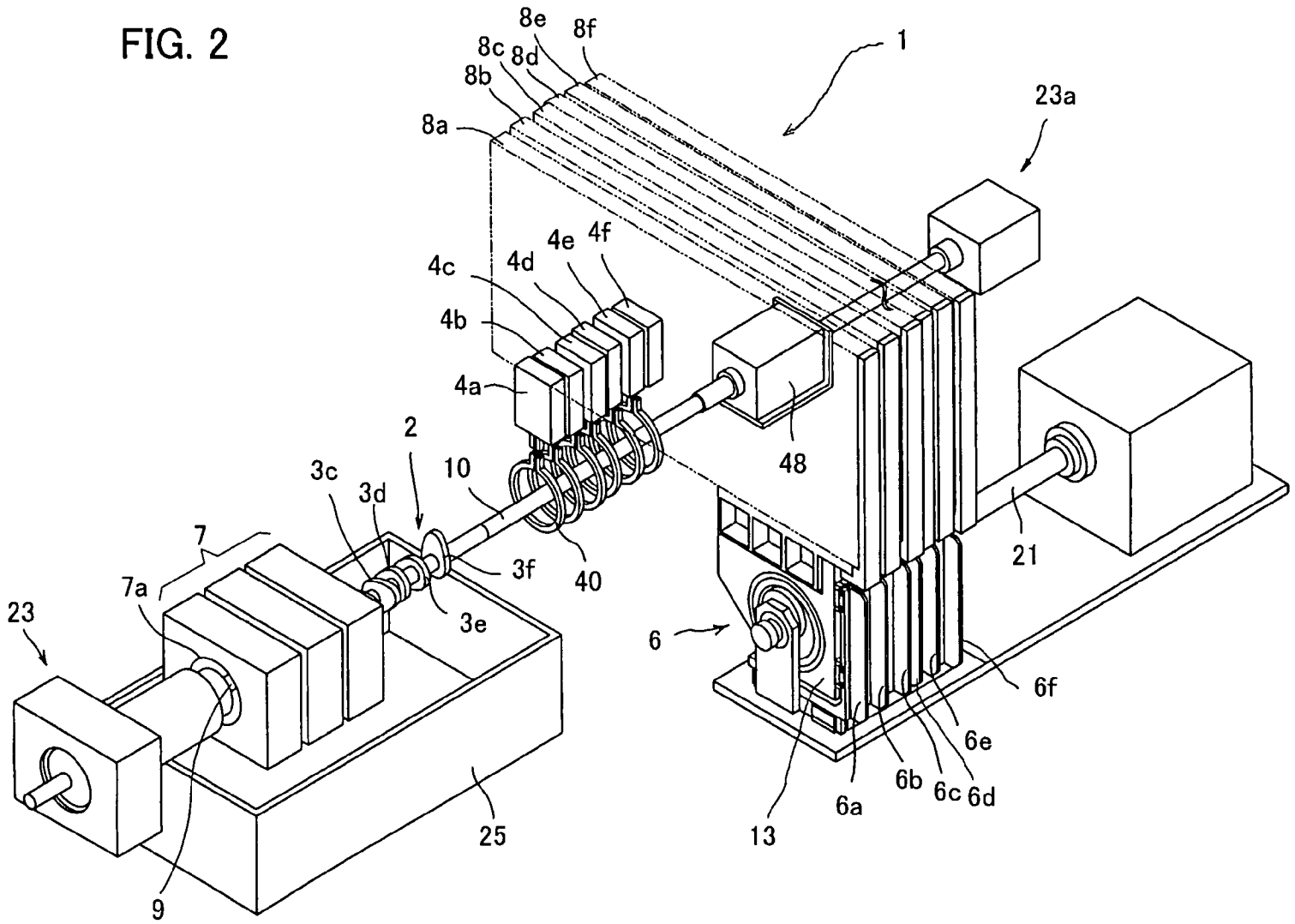
FIG. 2 is a perspective entire view of a hardening apparatus according to the present invention.
Figure 3:
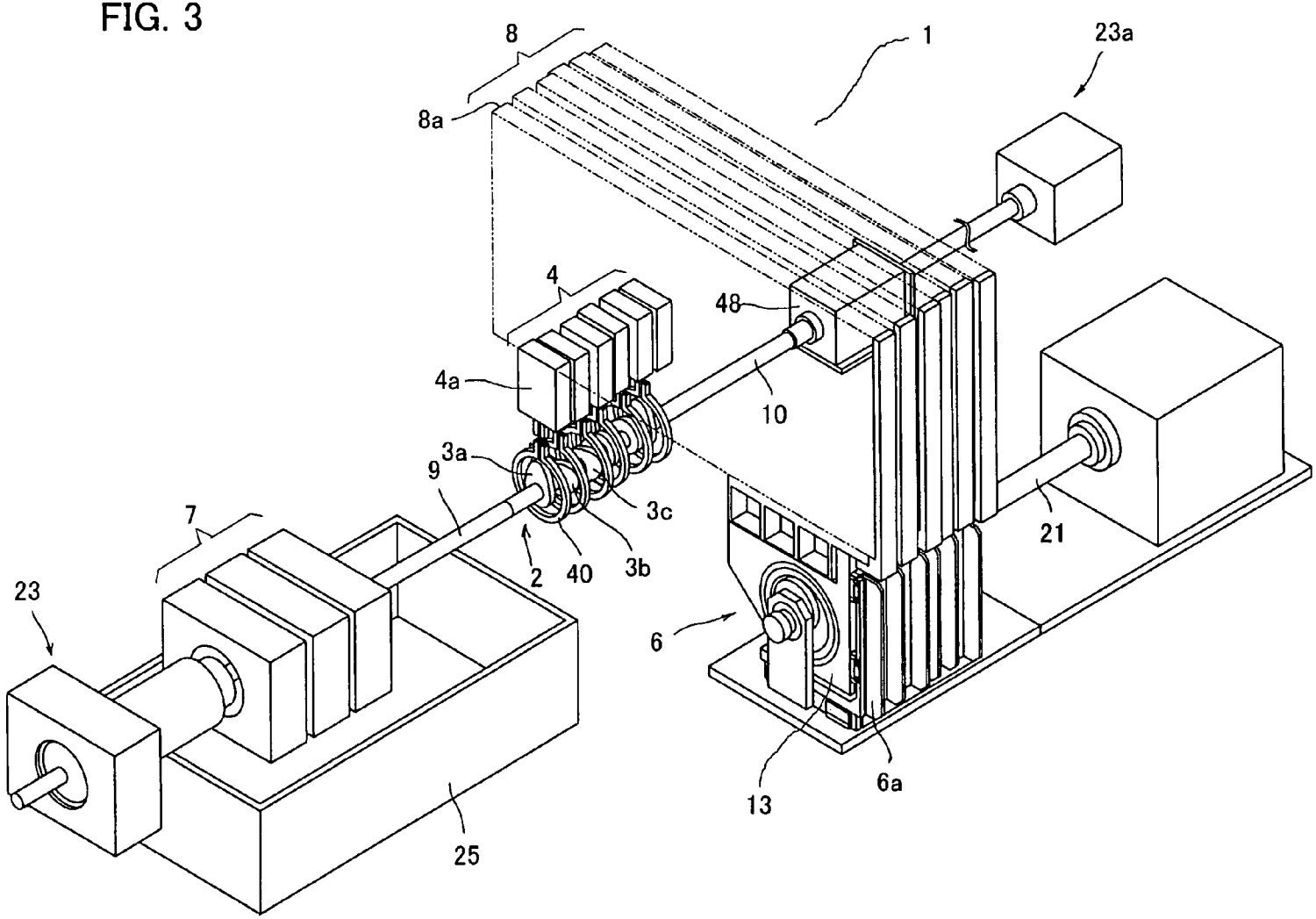
FIG. 3 is a perspective view of the hardening apparatus of FIG. 2 in which the heating coils are in process of heating the work.

FIGS. 2, 3 show a hardening apparatus 1 which has an eccentric rotor assembly 6 having eccentric rotors 6*a* to 6*f* respectively connected to heating coil holders 4*a* to 4*f* through bridging members 8*a* to 8*f* so that the eccentric rotations of the rotors 6*a* to 6*f* cause the heating coils 40 to rotate eccentrically. Herein, the eccentric rotor assembly 6 supports a plurality of eccentric rotor mounts 13 each of which has an eccentric rotor 6*a* to 6*f*, respectively. The mount 13 is supported by a supporting frame 12 on a base 5, the detail of which will be described by referring to FIGS. 4 and 5. In this way, it is ensured that the heating coil holders 4*a* to 4*f* and the eccentric rotors 6*a* to 6*f* constitute an interrelated entity.

In FIGS. 2 and 3 each of the heating coil holders 4*a* to 4*f* is provided with a heating coil 40. The bridging members 8*a* to 8*f* are located above the heating coil holders 4*a* to 4*f*, each heating coil holder 4*a* to 4*f* accommodating transformers, inverters and power sources (all of them not shown for simplicity), so that the heating coils 40 are supplied with an electric current induced so as to heat the works.

The example shown in FIGS. 2 and 3 uses a cam shaft 2 as a work to be hardened, which is loaded between supporting rods 9 and 10 while being passed through the coils 40 of the coil holders 4*a* to 4*f*. It is difficult to harden a cam shaft to an even depth because of the various shapes of the cams. In order to achieve the equal hardening the heating coils are required to move in correspondence with the shape of the cams as the work. The cam shaft 2 can be reciprocally moved by moving the supporting rods 9 by means of servomotors 23 and 23*a*, respectively. During the passage through the heating coils 40 each cam 3*a* to 3*f* of the cam shaft 2 is heated by the heating coils 40. The number of the heating coil holders 4*a* to 4*f* (i.e. that of the heating coils 40) is decided as desired.

Either of servomotors 23 and 23*a* is operated so as to cause the cam shaft 2 rightward or leftward as it is required, or entirely withdrawn so as to avoid collision with the heating coils 40.

The supporting rod 9 is rotatively supported at its one end by means of one bearing, and the supporting rod 10 is rotatively supported at its one end by another bearing, and both are moved in the same way by means of a motor 48. The rotation of the supporting rod 10 causes the cam shaft 2 to rotate. The motor 48 reciprocally moves together with the supporting rod 10 in the latter's axial direction.

The supporting rods 9, 10 and the cam shaft 2 are coaxial, and cooling jackets 7 are held on the same axis. More specifically, the illustrated example has three cooling jackets 7 each of which has a bore 7*a* whose inside diameter is larger than the outside diameters of the supporting rod 9 and the cam shaft 2 so as to enable them to pass through the bore 7*a*. The inside wall of the jacket 7 is provided with a number of pores (not shown) through which a coolant is sprayed onto the work passing through the bore 7*a*. The coolant is supplied to the jacket 7 through a suitable duct (not shown). The coolant is sprayed toward and over the cam shaft 2 being processed at a given time intervals while the cooling jacket 7 is reciprocally moved along the axis of the supporting rods 9 and 10.

After the cam shaft 2 is heated by the heating coil 40, it is moved into the jacket 7 where the shaft 2 is quickly cooled by the coolant shower through the jackets 7.

The eccentric rotors 6*a* to 6*f* will be described by referring to FIGS. 4 and 5: As described above, these rotors 6*a* to 6*f* are mounted on the eccentric rotor assembly 6, which houses a seat 11, a supporting frame 12 (hereinafter "frame"), eccentric rotor mounts 13, and cams 14.

The seat 11 is provided on a base 5. In FIG. 2 the seat 11 is omitted for explanatory convenience. The seat 11 is provided with a first guide 15 having a first guide groove 15*a* and a second guide 16 having a second guide groove 16*a*. The guides 15 and 16 are straight. The frame 12 takes an L-form defined by a lower member 12*a* and an upright member 12*b* as best shown in FIGS. 4 and 5. The lower member 12*a* is provided with a rail 17 which is engaged with the guide grooves 15*a* and 16*a*, thereby allowing the frame 12 to move leftward and rightward in FIG. 4 with respect to the seat 11.

The upright member 12*b* is provided with a guide 18 having a guide groove 18*a* and a guide 19 having a guide groove 19*a*. There is provided an eccentric rotor mount 13 having a rail 20 in its right side (in FIGS. 4 and 5) which is engaged with the guide grooves 18*a* and 19*a*, thereby allowing the eccentric rotor mount 13 to move vertically with respect to the frame 12.

Figure 4:
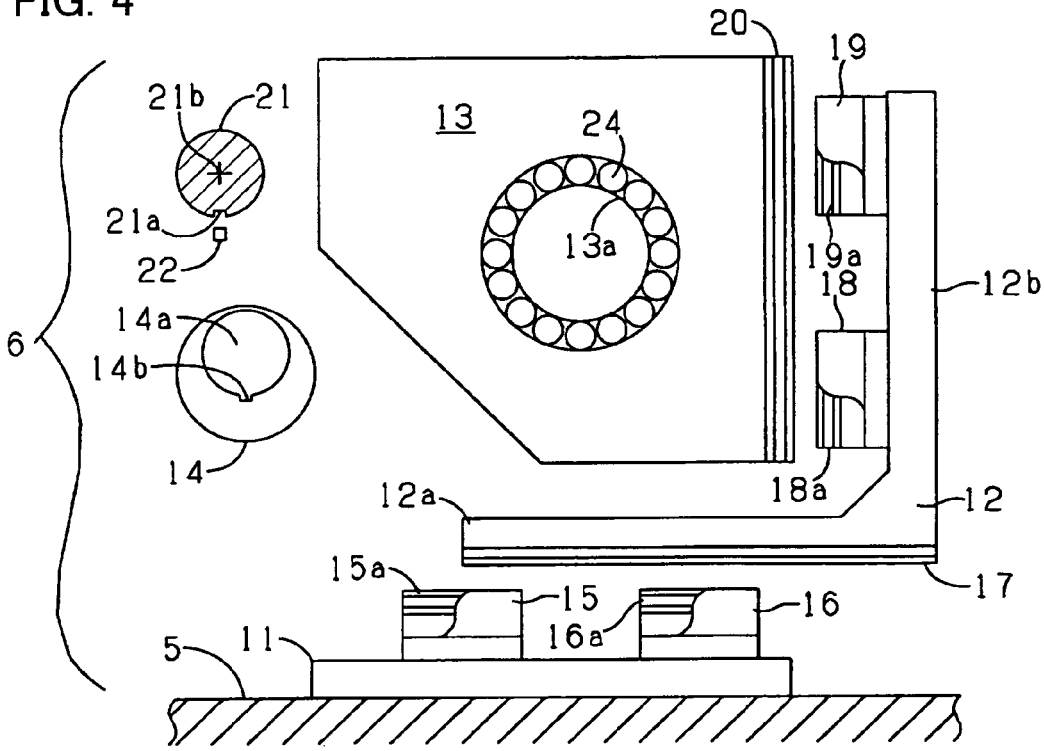
FIG. 4 is an exploded view of an eccentric rotor assembly and an eccentric rotor mount to show the relationship therebetween.

In the version illustrated in FIG. 4 the seat 11 and the frame 12 are respectively provided with two guides 15, 16 and 18, 19 but the number of these guides can be selected as desired so long as the frame 12 and the eccentric rotor mount 13 are stably supported.

As diagrammatically shown in FIG. 4, the eccentric rotor mount 13 is provided with a bore in which bearing balls 24 are provided as schematically illustrated in FIG. 4, the bore having the bearing balls 24 being referred to as "bore 13*a*". The tops of each ball 24 project inside. As shown in FIG. 5, the bore 13*a* has a cam 14 fitted in, wherein the cam 14 is subjected to a thrusting force of the balls 24. In this state the cam 14 can rotate on the bearing balls 24.

As shown in FIG. 4, the cam 14 is circular, having its own bore 14*a* which is eccentrically located with respect to the center of the circular cam 14. The bore 14*a* is provided with a key-way 14*b*. The cam 14 is a positive motion cam.

Figure 5:
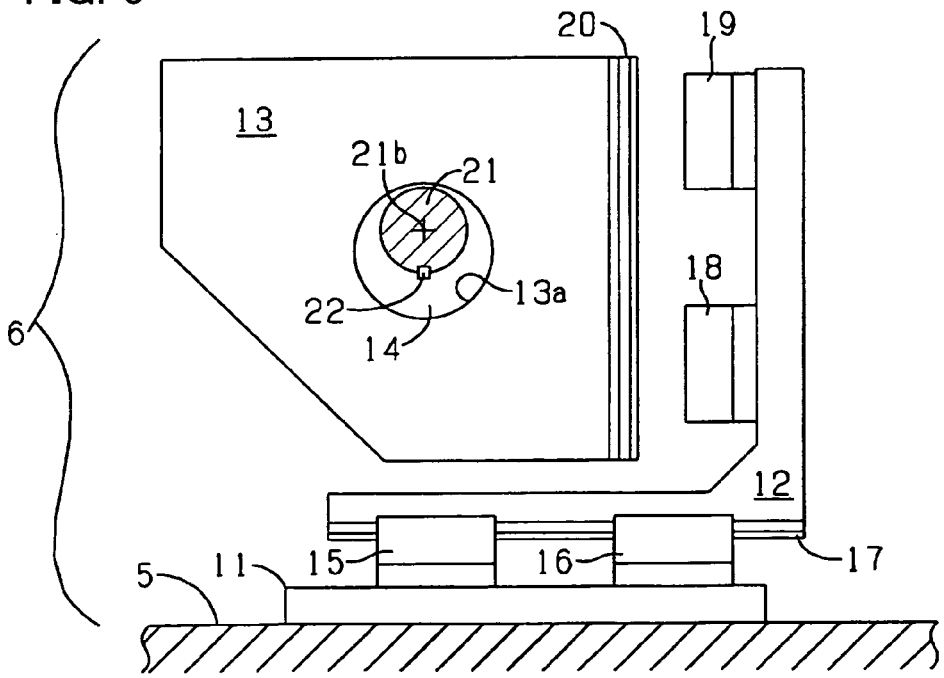
FIG. 5 is an exploded view of the eccentric rotor assembly and the eccentric rotor mount of FIG. 4 when they are in operation.

As shown in FIG. 5, a shaft 21 is passed through the bore 14*a*. The inside diameter of the bore 14*a* is larger than the outside diameter of the shaft 21, which has a key-way 21*a* located corresponding to the key-way 14*b* of the cam 14. A key 22 is fitted in the key-way 21*a*, and then the cam 14 is fitted onto the shaft 21, thereby causing the cam 14 to move in the direction vertical to the paper of FIG. 4; that is, in the axial direction of the shaft 21, where the key 22 fits in the key-way so as to fasten the cam 14 to the shaft 21 in a non-rotative manner. Thus, the cam 14 can rotate together with the shaft 21 around the axis 21*b* by operating the motor. The shaft 21 rotates in synchronism with the supporting rod 10, which functions as a power source for the cam shaft 2.

The cam 21 is provided with a number of key-ways 21*a* corresponding to that of the cams 3*a* to 3*f* of the cam shaft 2, wherein the plurality of key-ways 21*a* are located at intervals lengthwise of the axis of the shaft 21, not on the diametrically opposite peripheral positions of the shaft 21. In addition, their positions are displaced from one to another at a predetermined angle (in the illustrated embodiment, at 120*o*). The arrangement of the key-ways 21*a* corresponds to the eccentric positions of the cams 3*a* to 3*f* of the heating coil holders 4*a* to 4*f*. In FIGS. 3 to 8, a single key-way 21*a* alone is shown for explanatory convenience. At any rate, these devices are conventional, so that a detailed description will be omitted.

In this way the cam 14 held by the shaft 21 is inserted into the bore 13*a* of the eccentric rotor mount 13. The inside diameter of the bore 13*a* is slightly larger than the outside diameter of cam 14. As the shaft 21 rotates, the peripheral surface of the cam 14 eccentrically presses the inside wall of the bore 13*a* while it is sliding thereon.

The illustrated version has six eccentric rotor mounts 13 each being mounted on the shaft 21 through the cams 14, wherein the cams 14 are differently directed, thereby causing the eccentric rotor mounts 13 to take different positions. In this situation, each cam 14 rotates about the axis 21*b* of the shaft 21 while it presses its mating eccentric rotor mount 13 in the eccentric direction in the sliding motion.

Previously, the rail 20 of the eccentric rotor mount 13 engages in the guide groove 18*a* of the guide 18 of the frame 12 secured to the seat 11 and also in the guide groove 19*a* of the guide 19. As a result, the shaft 21 securing the six eccentric rotor mounts 13 are caused to approach the frame 12 from above, until each eccentric rotor mount 13 engages its mating frame 12.

In this situation a greater part of the weight of the eccentric rotor mounts 13 is supported by the shaft 21 through the bore 13*a*, and the eccentric rotor mounts 13 are held by the seat 11 and the frame 12 so as to be motionless or not rotative.

The shaft 21 is rotated by the servomotor 23 shown in FIG. 2. As is stated above, each eccentric rotor 6*a* to 6*f* is located at different angular position from each other, but each moves in the same manner, except when they position differently as the shaft 21 starts its own rotation. For illustration purpose, in FIGS. 6 to 9, one of the eccentric rotors 6*a* to 6*f* alone is shown to show the different eccentric positions taken by them during the rotation of the shaft 21.

Figure 6:
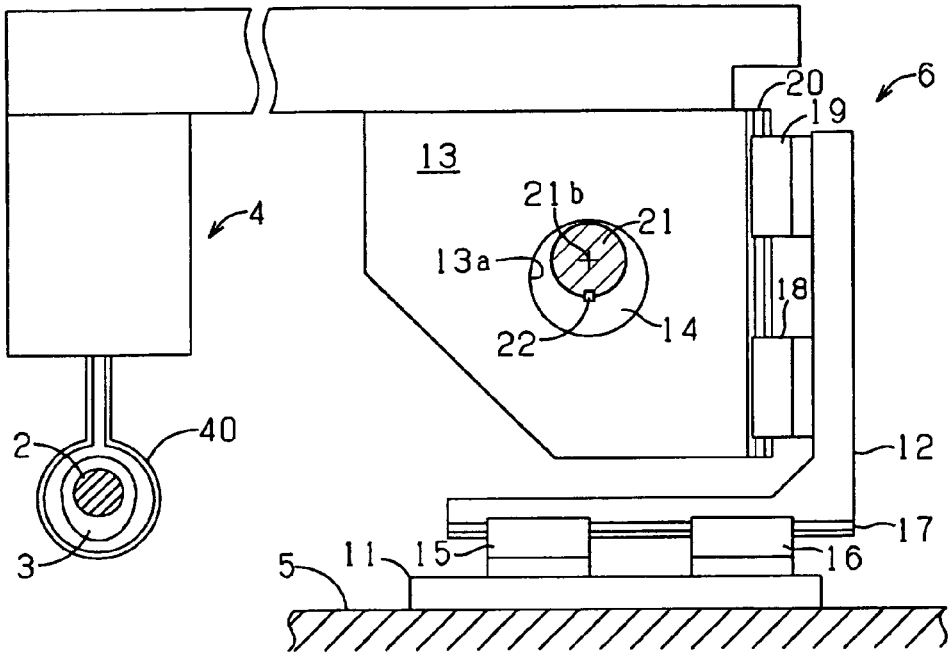
FIG. 6 is a front view showing the relationship among a heating coil holder, an eccentric rotor assembly, and an eccentric rotor mount.
Figure 7:
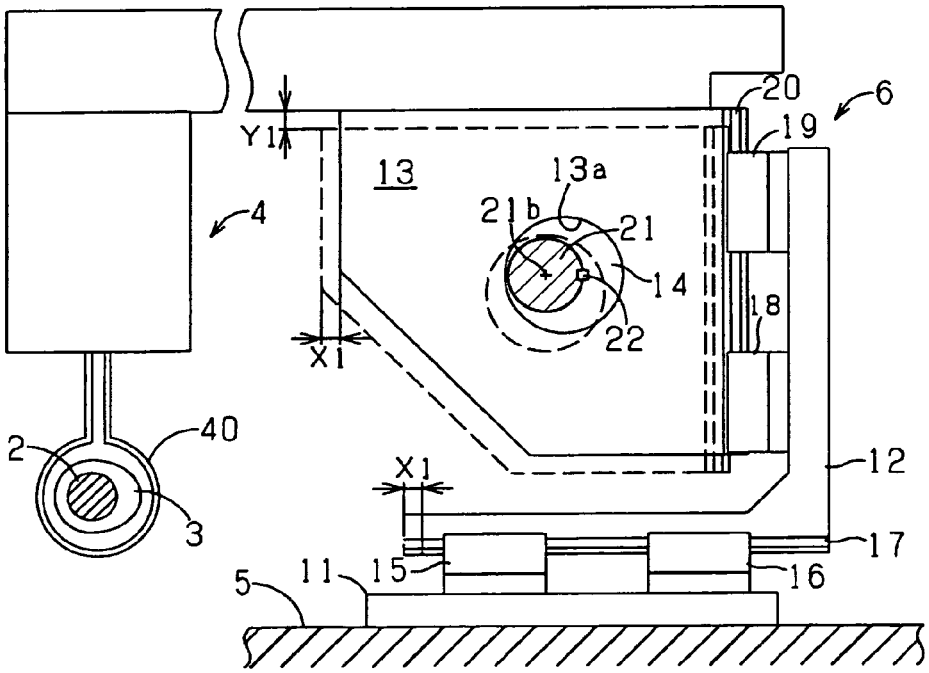
FIG. 7 is a front view of the same combination as that of FIG. 6 wherein the shaft of the assembly is rotated at right angle.

Suppose that in FIG. 6 the shaft 21 is rotated anti-clockwise at right angle. As a result, the state shown in FIG. 7 is reached, where each of the eccentric rotor mounts 13 (the bore 13*a*) is pressed by the cam 14, and slightly moved upward by a distance $Y_1$ against the frame 12 which, in turn, moves rightward (FIG. 7) by a distance $X_1$. As a result, the eccentric rotor mount 13 moves upward by a distance $Y_1$, and rightward by a distance $X_1$. The dotted line in FIG. 7 shows a position of the eccentric rotor mount 13 of FIG. 6.

Figure 8:
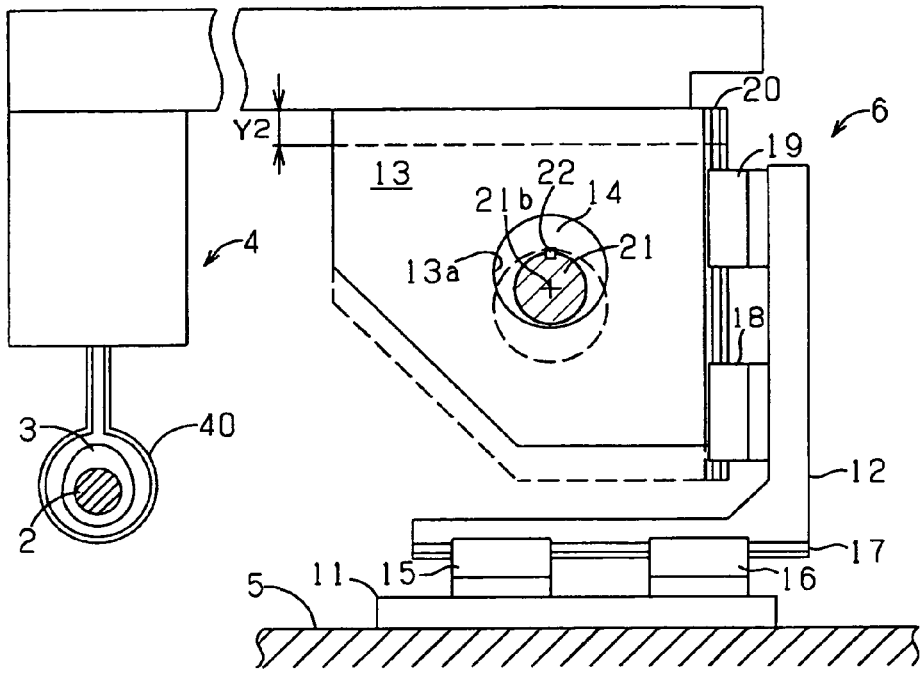
FIG. 8 is a front view showing the same combination as that of FIG. 7 wherein the shaft of the assembly is further rotated at right angle.

As shown in FIG. 8, when the shaft 21 is further rotated anti-clockwise at right angle, the eccentric rotor mount 13 pressed by the cam 14 is moved upward by a distance $Y_1$ and leftward by a distance $X_1$ each from the position shown in FIG. 7. As a result, the eccentric rotor is moved upward by a distance $Y_2$ ($Y_2=Y_1+Y_1$) and neither rightward nor leftward. The dotted line in FIG. 8 shows the position of the eccentric rotor mount 13 of FIG. 6.

Figure 9:
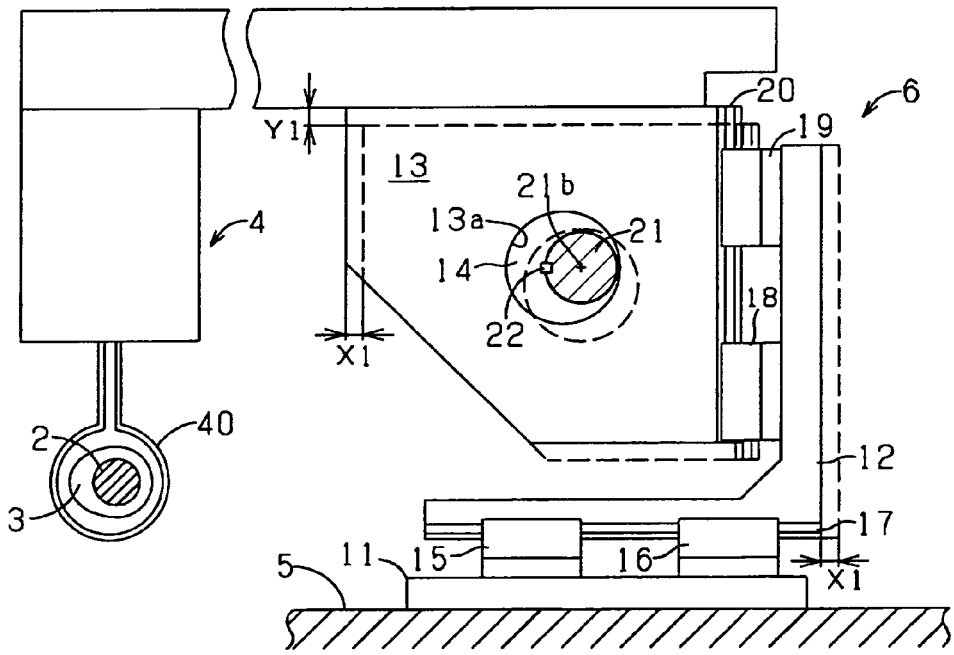
FIG. 9 is a front view showing the eccentric rotor mount shown in FIG. 8 and the heating coil when the shaft of the assembly is further rotated at right angle.

When the shaft 21 is rotated anti-clockwise at right angle from the position shown in FIG. 8, the eccentric rotor mount 13 is moved downward by a distance $Y_1$ and leftward by a distance $X_1$ from the position shown in FIG. 8. In this way, the state shown in FIG. 9 is reached. As a result, the eccentric rotor mount 13 is moved upward by a distance $Y_1$ and leftward by a distance $X_1$ from the position shown in FIG. 6

When the shaft 21 is rotated anti-clockwise at right angle from the state shown in FIG. 9, the state shown in FIG. 6 is regained.

As is evident from the foregoing description, the rotation of the shaft 21 causes the frame 12 of the eccentric rotor assembly 6 to move rightward or leftward with respect to the seat 11, and also causes the eccentric rotor mount 13 to move upward and downward with respect to the frame 12, and causes the eccentric rotor mount 13 to rotate smoothly in an eccentric manner.

In the illustrated embodiment six eccentric rotor assemblies 6*a* to 6*f* are secured to the shaft 21 at different angular positions (the eccentric positions) previously determined for each of the works 3*a* to 3*f* to be hardened.

The heating coil holders 4*a* to 4*f* are respectively held by their own mating eccentric rotors 6*a* to 6*f* through the bridging members 8*a* to 8*f*; more specifically, the coil holder 4*a* is held by the assembly 6*a* through the bridging member 8*a*, and so on. As a result, by rotating the shaft 21 each heating coil holder 4*a* to 4*f* rotates along the profile of the works 3*a* to 3*f*.

FIG. 4 shows a version where the lower part 12*a* of the frame 12 intersects with the side part 12*b* thereof at right angle but the 90° angular intersection is not always required. It can be an acute angle or an obtuse angle.

Figure 10A:
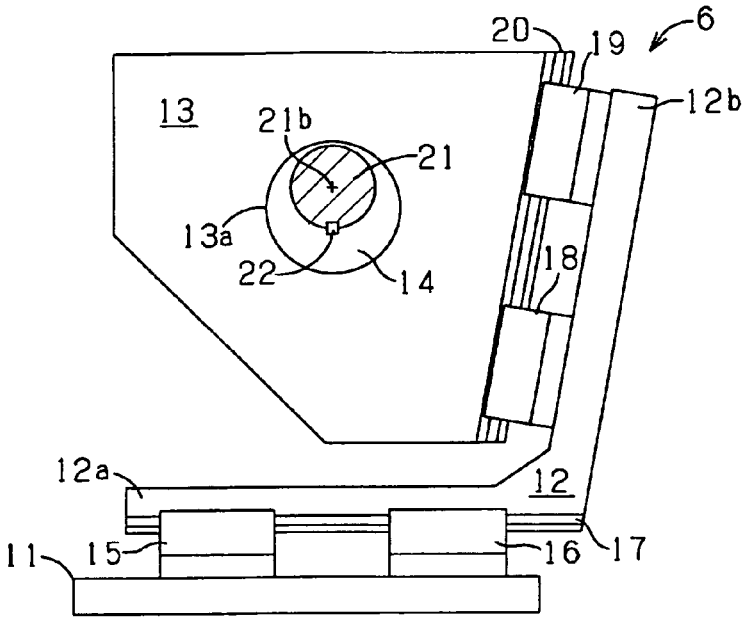
FIG. 10A is a front view of a modified version of the eccentric rotor assembly shown in FIG. 6.
Figure 10B:
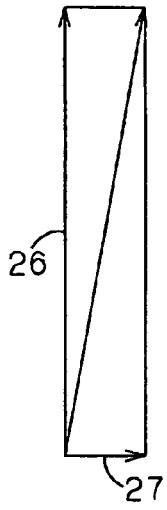
FIG. 10B is a vector diagram showing the movement of the modified eccentric rotor assembly shown in FIG. 10A.

Referring to FIGS. 10A and 10B, an instance of performing at an obtuse angle will be described:

FIG. 10A is a front view showing the eccentric rotor mount where the lower part and the side part of the frame intersect with each other at an obtuse angle. FIG. 10B is a vector diagram showing a vertical component and a horizontal component of the direction in which the eccentric rotor moves along the frame 12.

When the shaft 21 rotates and the eccentric rotor mount 13 vertically moves, the eccentric rotor mount 13 also moves horizontally by a vector 27 (FIG. 10B) against a vector 26. Therefore, by making the quantity of horizontal movement of the frame 12 for the seat 11 equal to a distance obtained by reducing an equivalent to the vector 27 from the distance $X_1$ shown in FIG. 6, the eccentric rotor mount 13 can eccentrically rotate for each of the works 3*a* to 3*f* to be hardened.

Figure 11A:
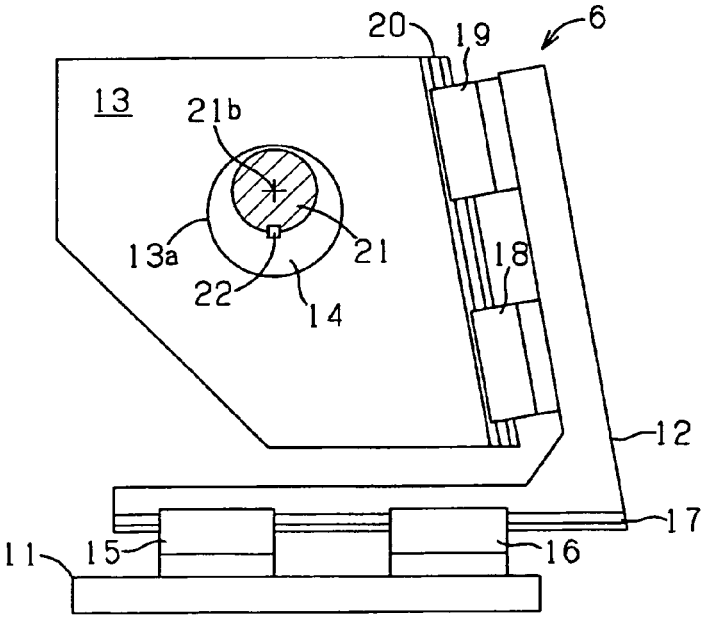
FIG. 11A is a front view of another modified version of the eccentric rotor assembly shown in FIG. 6.
Figure 11B:
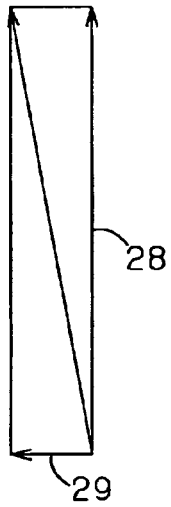
FIG. 11B is a vector diagram showing the movement of the modified eccentric rotor assembly shown in FIG. 11A.

Referring to FIGS. 11A and 11B, an instance of performing at an acute angle will be described:

FIG. 11A is a front view showing the eccentric rotor mount 13 where the lower part and the side part of the frame 12 intersect with each other at an acute angle. FIG. 11B is a vector diagram showing a vertical component and a horizontal component of the direction in which the eccentric rotor mount 13 moves along the frame 12.

When the shaft 21 rotates and the eccentric rotor mount 13 vertically moves, the latter also moves horizontally by a vector 29 (FIG. 11B) against a vector 28. Therefore, by making the quantity of horizontal movement of the frame 12 for the seat 11 equal to a distance obtained by adding an equivalent to the vector 29 from the distance $X_1$ shown in FIG. 7, the eccentric rotor mount 13 can eccentrically rotate for each of the works 3*a* to 3*f* to be hardened.

In FIGS. 6 to 9, the eccentric quantities of the cam 14 (the distances $X_1$, $Y_1$, $Y_2$) are exaggeratingly shown as compared with those of the cams 14 so as to clearly illustrate the structure of the eccentric rotor mount. In fact, the eccentric quantity of the cam 14 is equal to that of the cam 3.

The hardening apparatus 1 is operated as follows:

First, the cam shaft 2 (the work) is loaded between the supporting rods 9 and 10 of the apparatus 1. The supporting rods 9 and 10 can slide in their axial direction by means of the servomotors 23 and 23*a*, thereby allowing the cam shaft 2 to stay between the supporting rods 9 and 10 with no heating coil 40 or any other obstructing the work 2 from being placed therebetween, wherein the supporting rod 10 passes through the heating coil holders 4*a* to 4*f*. The power source is not limited to the servomotors; for example, a pneumatic cylinder may be used.

Before the cam shaft 2 is loaded, the cooling jacket 7 is desirably withdrawn so as to give way to the cam shaft 2. The cooling jacket 7 also can slide along the supporting rods 9 and 10.

When the cam shaft 2 has been loaded between the supporting rods 9 and 10, they are moved so as to cause the works (cams) 3*a* to 3*f* to locate near the heating coil holders 4*a* to 4*f*.

The cams 3*a* to 3*f* are arranged along the length of the cam shaft 2, and the neighboring two cams 3*a* and 3*b* are paired. The angles at which the cams 3*a* and 3*b* are secured to the cam shaft 2 are different at 120° from each other, where, however, the adjacent two cams (for example, the cams 3*b* and 3*c*) are secured to the shaft 2 at the same angle.

Each heating coil holder 4*a* to 4*f* is eccentrically located at a position corresponding to that of its mating cam 3*a* to 3*f*, so that the cams 3*a* to 3*f* are hardened to an even depth.

While the cam shaft 2 (the supporting rod 10) and the shaft 21 are synchronously rotated, the cam shaft 2 is thermally hardened. At this stage, the cooling jacket 7 is shifted to above the tray 25.

When the cam shaft 2 has been heated, the cam shaft 2 is quickly shifted to the cooling jacket 7, and the jacket 7 is caused to spray cooling liquid over the cam shaft 2.

When the cam shaft 2 has been cooled the hardening process is finished. The cooling jacket 7 is withdrawn, and the supporting rods 9 and 10 are released from holding the cam shaft 2, thereby unloading the cam shaft 2 from the apparatus 1. Then, the sequence advances to where the next cam shaft is loaded between the supporting rods 9 and 10. This procedure is repeated.

The members inter-located between the cam shaft 2 and the frame 12 can be removed from the apparatus 1. The number, size and shape of the works to be loaded on the apparatus 1 are different as the case may be. Accordingly, the shaft 21 and the cam 14 are appropriately selected, thereby constituting the effective eccentric rotor assembly 6. The synchronous rotations of the cam shaft 2 and the shaft 21 ensure that the distance between each cam 3*a* to 3*f* to be processed and the mating heating coil holders 4*a* to 4*f* are constant, thereby enabling the work to be hardened to an even depth.

Figure 12A:
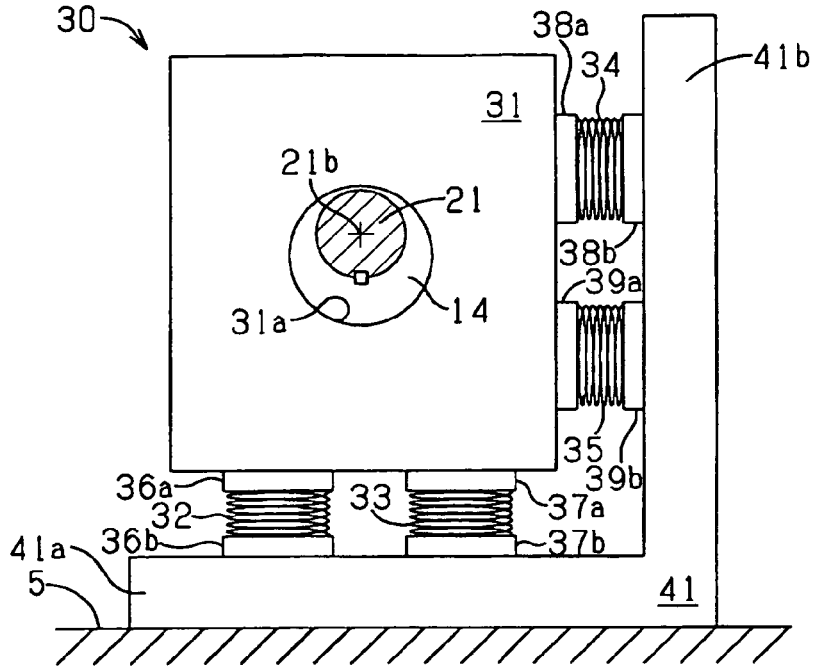
FIG. 12A is a front view of the eccentric rotor mount supported by springs.

A modified version of the present invention will be described by referring to FIGS. 12A and 12B:

As shown in FIG. 12A, there is provided an eccentric rotor assembly 30 having an eccentric rotor mount 31, a cam 14, springs 32 to 35, and a supporting frame 41. The eccentric rotor assembly 30 is different from the eccentric rotor assembly 6 (FIG. 6) in that the behavior of the eccentric rotors are regulated in a plane, and that they are differently shaped, but both are the same in that the eccentric rotors are rotated by the cam 14. More specifically, the eccentric rotor mount 13 employs the springs 32 to 35 as elastic members in place of the seat 11 and the frame 12, and the shape of the eccentric rotor mount 31 is different from that of the eccentric rotor mount 13.

Figure 12B:
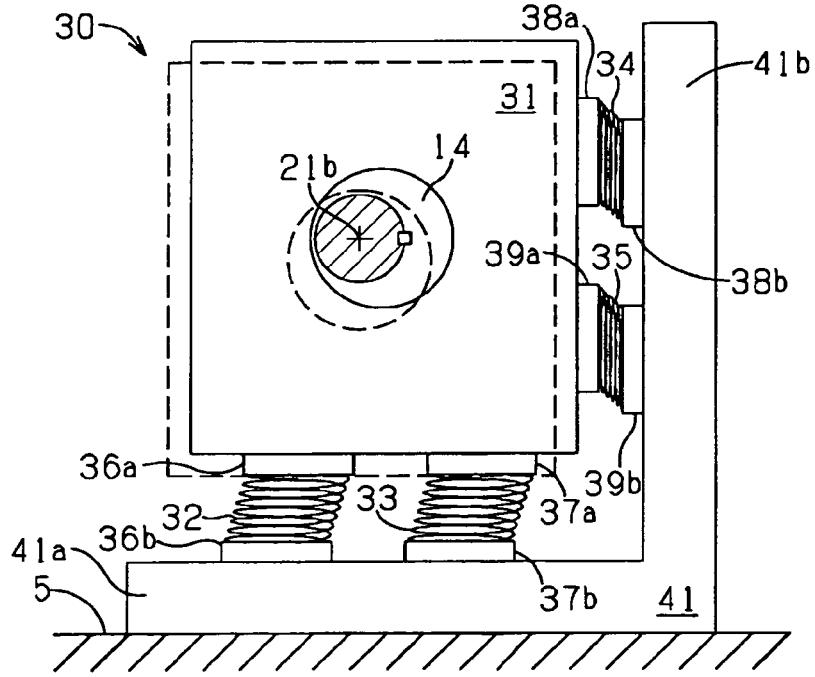
FIG. 12B is a front view showing another aspect of the eccentric rotor mount shown in FIG. 12A.

As shown in FIGS. 12A and 12B, the L-shaped supporting frame 41 includes a lower side 41*a* and an erect side 41*b*. The frame 41 is secured to a base 5. The eccentric rotor mount 31 is secured to the frame 41 through the springs 32 to 35 which are secured to bases 36*a*, 36*b*, and sides 37*a*, 37*b* between the rotor mount 31 and the lower side 41*a* of the frame 41, and to the bases 38*a* and 38*b*, 39*a* and 39*b* between the rotor mount 31 and the erect side 41*b* of the frame 41. The springs 32 to 35 elastically support the rotor mount 31.

Most of the weight of the eccentric rotor mount 31 is supported by the shaft 21, and the rotor mount 31 is provided with guides (not shown) located in front and behind with respect to the paper of FIG. 12A. Therefore, the rotation of the shaft 21 causes the rotor mount 31 to rotate eccentrically in the position shown in FIG. 12A.

FIG. 12B shows a state reached when the shaft 21 is rotated anti-clockwise at right angle from the state shown in FIG. 12A. As shown in FIG. 12B, the eccentric rotor mount 31 eccentrically rotates with no declines from the position indicated in dotted line to the position indicated in solid line.

At this stage, the springs 32 and 33 expand right upward, whereas the springs 34 and 35 contract right upward. When the shaft 21 further rotates, each spring 32 to 35 expands and contracts as required, so as to prevent the eccentric rotor mount 31 from becoming declined.

Another modified version will be described by referring to 13A and 13B:

An eccentric rotor mount 46 is accommodated in an eccentric rotor assembly 42 and driven by the cam 14 of the shaft 21 in the same manner as the eccentric rotor mount 13 of FIG. 6 is. There is provided a four-joint linkwork 45 on the eccentric rotor mount 46 with its lower link being connected thereto. The upper link of the linkwork 45 is connected to a ceiling 43 by means of a spring balancer 44.

The eccentric rotor mount 46 moves leftward and rightward by the linkwork 45, and can vertically move by the spring balancer 44. In this way, the rotation of the shaft 21 causes the eccentric rotor mount 46 to rotate smoothly with no decline. The eccentric rotor mount 46 is secured to the heating coil holder 4 by the bridging member 47. Therefore, the eccentric rotation of the eccentric rotor mount 46 causes the heating coils 40 of the heating coil holder 4 to rotate eccentrically.

Figure 13A:
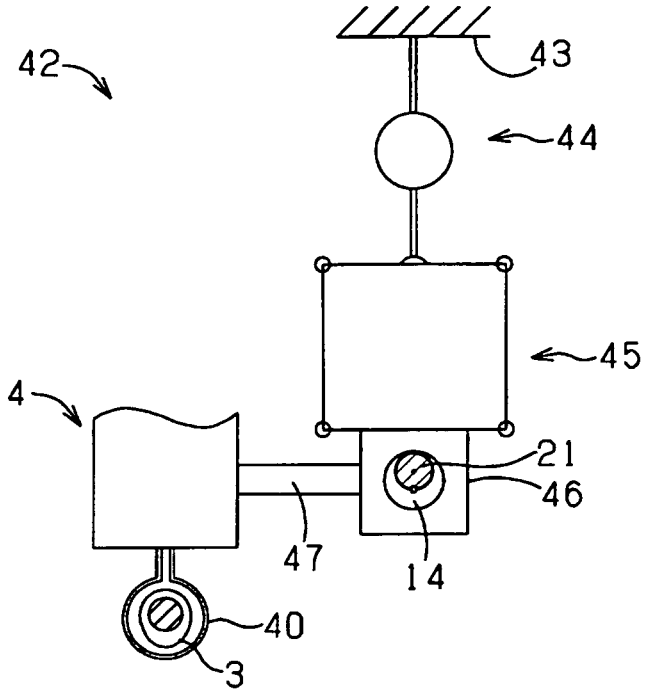
FIG. 13A is a schematic front view showing a modified eccentric rotor assembly.
Figure 13B:
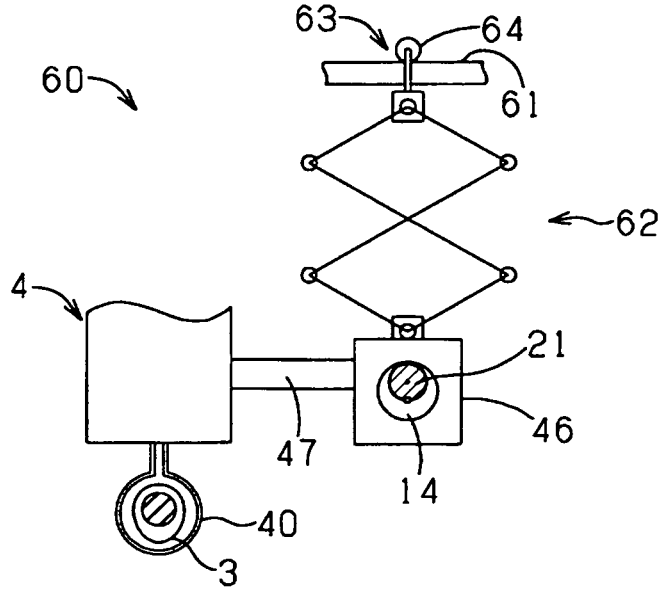
FIG. 13B is a schematic front view showing another modified eccentric rotor assembly.

An eccentric rotor mount 46 of the eccentric rotor assembly 60 shown in FIG. 13B is driven by the cam 14 held by the shaft 21, just like the eccentric rotor mount 13 shown FIG. 6. There is provided a pantograph-like member 62 connected to the upper part of the eccentric rotor mount 46. Its upper part is connected to the supporting member 63 which is provided with a wheel 64. The wheel 64 runs on a rail 61 horizontally held. The pantograph-like member 62 allows the eccentric rotor mount 46 to move vertically, and the wheel 64 allows it to move leftward and rightward As a result, the eccentric rotor mount 46 eccentrically rotates in accordance with the rotation of the shaft 21. Accordingly, the heating coils 40 of the heating coil holder 4 secured to the bridging member 47 can eccentrically rotate together.

In the foregoing description of the eccentric rotor assembly 6 and 30, they are so arranged to ensure that even when the cam shaft 2 (the work to be hardened) rotates, the distances between the heating coils 40 and the peripheral surface of each cam 3*a* to 3*f* (the work) are kept constant.

In an alternative embodiment, it is possible to arrange so that those distances change in accordance with the rotation of the cam shaft 2 (the work), wherein an inverter (not shown) is employed to adjust the output of power, thereby ensuring that the works are hardened to an even depth. The output of power is adjusted in accordance with the change in the distances between the work and the heating coil; more specifically, when the distance is shortened, the output is decreased, and when it is widened, the output is increased, so as to harden the works to an even depth.

What is claimed is:

1. A high-frequency induction hardening apparatus for metal objects, comprising:

a plurality of heating coil holders, each for holding a heating coil for hardening a metal object, and a plurality of eccentric rotor mounts each having one of the heating coils associated therewith, wherein the heating coils are held so as to be eccentrically rotative through a cam mechanism that moves around an axis to move the eccentric rotor mounts and thereby the associated heating coil holders; and first and second supporters limiting movement of each heating coil to a plane intersecting the axis of the cam mechanism and keeping each heating coil in a desired position, the first supporters each guiding movement of one of the eccentric rotor mounts and an associated heating coil holder along a first line, the second supporters guiding movement of the first supporters along a second line that is angled with respect to the first line, the hardening apparatus comprising separate pairs of guides and rails configured to cooperate with each other to guide movement of: a) the eccentric rotor mounts and thereby the associated heating coil holders in the first line; and b) the first supporters together with the eccentric rotor mounts and thereby the associated heating coil holders along the second line.

2. The apparatus of claim 1, wherein the first and second lines intersect with each other at a right angle.

3. The apparatus of claim 1, wherein each of the cam members is rotatively and integrally connected to the single shaft at a predetermined angular position.

4. The apparatus of claim 1, further comprising an eccentric rotor configured to rotate eccentrically through the cam mechanism, wherein the eccentric rotor is integrally connected to the heating coil holders, the first and the second supporters maintaining the eccentric rotor in an operative position, the first supporters guiding movement of either the heating coil holders or the eccentric rotor along the first line and the second supporters guiding movement of the first supporters along the second line, whereby the eccentric rotor moves in a plane intersecting the axis of the cam mechanism.

5. The apparatus of claim 1, further comprising an eccentric rotor configured to rotate eccentrically through the cam mechanism, wherein the eccentric rotor is integrally connected to the heating coil holders, the first and the second supporters supporting the eccentric rotor so as to move the eccentric rotor in two directions and not along the axis of the cam mechanism.

* * * * *